US006948694B1

(12) United States Patent
Gilbert

(10) Patent No.: US 6,948,694 B1
(45) Date of Patent: Sep. 27, 2005

(54) ARCHERY BOW AND ARROW STAND

(76) Inventor: Ralph D. Gilbert, 16013 E. Reno, Choctaw, OK (US) 73020

( * ) Notice: Subject to any disclaimer, the term of this patent is extended or adjusted under 35 U.S.C. 154(b) by 219 days.

(21) Appl. No.: 10/647,862

(22) Filed: Aug. 25, 2003

Related U.S. Application Data

(60) Provisional application No. 60/410,355, filed on Sep. 13, 2002.

(51) Int. Cl.[7] ..... F16M 13/00

(52) U.S. Cl. ..... 248/530; 248/156; 248/175; 124/23.1

(58) Field of Search ..... 248/156, 175, 248/530; 124/1, 23.1; 211/60.1; 206/315.11; D22/107; D6/552, 566

(56) References Cited

U.S. PATENT DOCUMENTS

| | | | | |
|---|---|---|---|---|
| 3,828,373 A | * | 8/1974 | Fraley | 4/646 |
| D260,674 S | | 9/1981 | Simmons | |
| D299,199 S | | 1/1989 | Rogowski | |
| 4,896,854 A | | 1/1990 | St. Laurent | |
| 4,938,446 A | * | 7/1990 | Williams | 248/530 |
| 5,111,800 A | | 5/1992 | Reynolds | |
| D337,808 S | * | 7/1993 | Parker | D22/148 |
| D375,645 S | | 11/1996 | Foster | |
| D375,993 S | | 11/1996 | Skinnes | |
| 5,711,467 A | | 1/1998 | Brown, Sr. | |
| D394,300 S | * | 5/1998 | Samuels et al. | D22/148 |
| 5,775,658 A | | 7/1998 | Englehardt | |
| D422,333 S | | 4/2000 | Foster | |
| 6,244,556 B1 | | 6/2001 | Carillo | |
| D448,446 S | * | 9/2001 | Walls et al. | D22/147 |
| 6,490,823 B1 | * | 12/2002 | Ibarra | 43/21.2 |
| 6,575,417 B1 | * | 6/2003 | Krommenakker | 248/311.2 |
| 6,584,967 B1 | * | 7/2003 | Paumen et al. | 126/30 |

* cited by examiner

*Primary Examiner*—Korie Chan
(74) *Attorney, Agent, or Firm*—Randal D. Homburg

(57) ABSTRACT

A bow and arrow stand, engaging the ground and holding an archery bow in an erect and upright position without contact with the bow string includes a vertical support shaft with an angular middle portion, an upper vertical portion and a lower vertical portion with a ground end tapering into a sharp point which is inserted into the ground, two padded horizontal members attached to the angular middle portion, an arrow quiver suspended from the lower vertical portion, a secondary ground engaging spike with a horizontal arm attached to the lower vertical portion, and a magnetic accessory bowl attached to the upper vertical portion to hold archery tools and accessories.

3 Claims, 3 Drawing Sheets

ARCHERY BOW AND ARROW STAND

CROSS REFERENCE TO RELATED APPLICATIONS

Provisional Patent Application Ser. No. 60/410/355 filed Sep. 13, 2002.

BACKGROUND OF THE INVENTION

1. Field of Invention

A bow and arrow stand, engaging the ground and holding an archery bow in an erect and upright position without contact with the bow string includes a vertical support shaft with an angular middle portion, an upper vertical portion and a lower vertical portion with a ground end tapering into a sharp point which is inserted into the ground, two padded horizontal members attached to the angular middle portion, an arrow quiver suspended from the lower vertical portion, a secondary ground engaging spike with a horizontal arm attached to the lower vertical portion, and a magnetic accessory bowl attached to the upper vertical portion to hold archery tools and accessories.

2. Description of Prior Art

The following United States patents were discovered and are disclosed within this application for utility patent. All relate to archery bow holders of some nature.

Several identified patents disclose bow holders which provide a means of holding an archery bow upright, but all these engage the bottom of the bow, which simply rests in a bow base holding apparatus. These patents include U.S. Pat. No. D260,674 to Simmons, D299,199 to Rogowski, D375,645 to Foster, D375,993 to Skinnes, D422,333 to foster, 4,896,854 to St. Laurent, 5,111,800 to Reynolds, and 6,244,556 to Carillo.

Two patents of prior art disclose bow holders which grip the bow and actually hold the bow without the end of the bow resting within some type of carriage device. They include U.S. Pat. No. 5,775,658 to Englehardt and U.S. Pat. No. 5,711,467 to Brown, Sr. The Brown patent discloses a dual hook device, shown attached to a tree trunk, which allows the bow to be grasped with the two hooks, engaging the bow horizontally, at the grip portion of the archery bow, the grip portion being larger than the lower hook, thereby allowing the bow to be supported by the grip portion, and balanced erect by the second hook, above the grip portion, best shown in FIG. 5 of that patent. The Englehardt patent discloses a pair of stationary rests to hold the front segment of an archery bow, with a spring loaded third arm to press against the rear segment of the archery bow, pinning and suspending the archery bow between the three arms, the spring loaded arm requiring use of one hand to release that arm, while holding the bow for removal with one's other hand.

The current invention is distinguished by its engagement with the ground by the tapered ground end vertical support shaft and a secondary ground spike, its positioning of the two padded horizontal members attached to the angular middle portion allowing for the placement of the bow without compression on the bow or engagement of the bottom of the bow with the ground, suspending the bow at or near the erect reach of the shooter, an arrow quiver engaging the lower vertical portion of the vertical support shaft, and the upper magnetic accessory bowl to hold arrow accessories.

SUMMARY OF THE INVENTION

When shooting archery in competition or simply for recreation, often very complex bows are used with a variety of very delicate aiming devices attached to the bow. These devices, once sighted for a target, are easily offset if they are bumped or if the archery bow is dropped or falls over. In addition, the ends of some archery bows have very intricate gear mechanisms, especially compound bows, that should not be exposed to dirt or the ground any more than necessary to prolong the efficiency of the gear mechanisms and to keep the bowstrings clean. Therefore, a need is presented to provide a bow holder that keeps a bow off the ground, sets the bow without a spring mechanism at a level easily reached by an erect shooter, and which does not cause any bump or other trauma or impact to the bow when placed in and drawn out of the bow holder.

A first objective of the bow and arrow stand is to provide a bow support which will allow the bow to be held above the ground readily accessible to a standing archer which does not engage the bow or bowstring with a hook and also prevents the aiming and sighting attachments from becoming dislodged or moved in the slightest during engagement and disengagement. A second objective is to provide an attached bow quiver and an accessory tray to provide the archer access and carriage of his entire shooting supplies and tools in a singular device. A third objective is to provide the device easily engaging the ground by simply stepping on the horizontal arm to engage the archery bow and arrow stand into the ground.

DESCRIPTION OF THE DRAWINGS

The following drawings are submitted with this utility patent application.

DESCRIPTION OF THE PREFERRED EMBODIMENT

Figure 1:
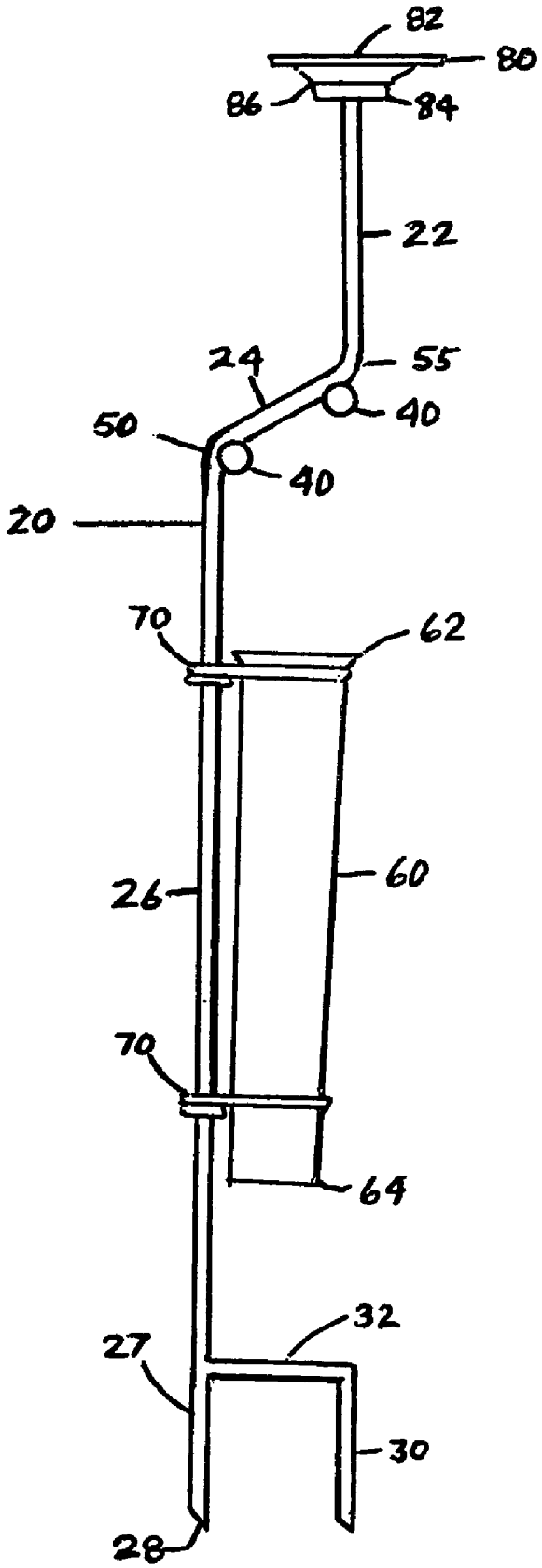
FIG. 1 is a side view of the bow and arrow stand.

A bow and arrow stand, shown in FIGS. 1–4 of the drawings, engaging the ground and holding an archery bow 100 in an erect and upright position without contact with the bow string or the end of the bow, comprises essentially a vertical support shaft 20 with an angular middle portion 24, an upper vertical portion 22 and a lower vertical portion 26, the lower vertical portion 26 having a ground end 27 tapered into a point 28 to be inserted into the ground, two padded horizontal members 40 attached to the angular middle portion 24, an arrow quiver 60 suspended from the lower vertical portion 26 by at least two detachable quiver brackets 70, a secondary ground spike 30 with a horizontal arm 32 attaching the secondary ground spike 30 to the lower vertical portion 26 and also to provide a place for foot pressure to drive the secondary ground spike 30 and the ground end 27 of the lower vertical portion 26 into the ground, and a magnetic accessory bowl 80 attached to the upper vertical portion 22 to hold arrow tips, Allen wrenches for the bow and other small metal archery tools and accessories.

Figure 3:
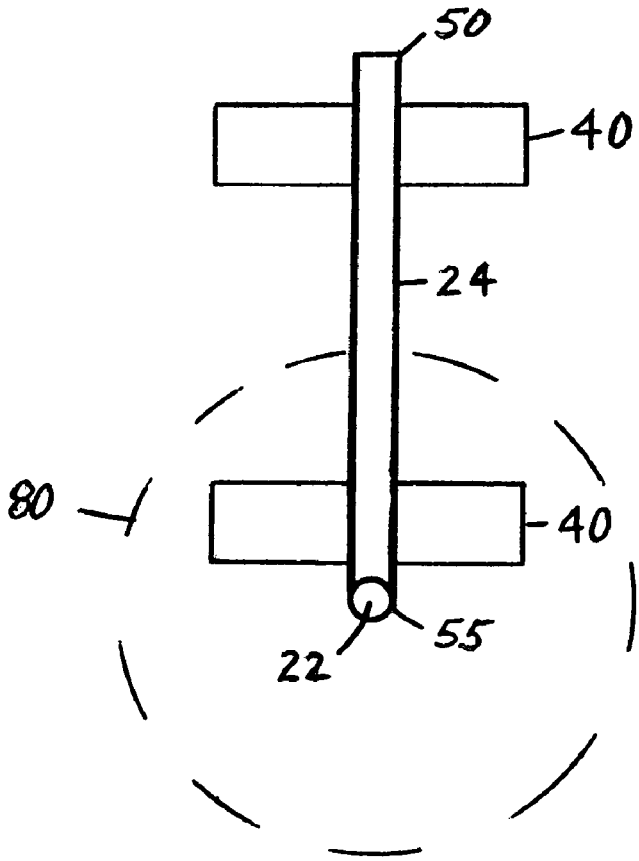
FIG. 3 is a top view of the bow and arrow stand with a dotted line indicating the location of the magnetic accessory bowl.
Figure 4:
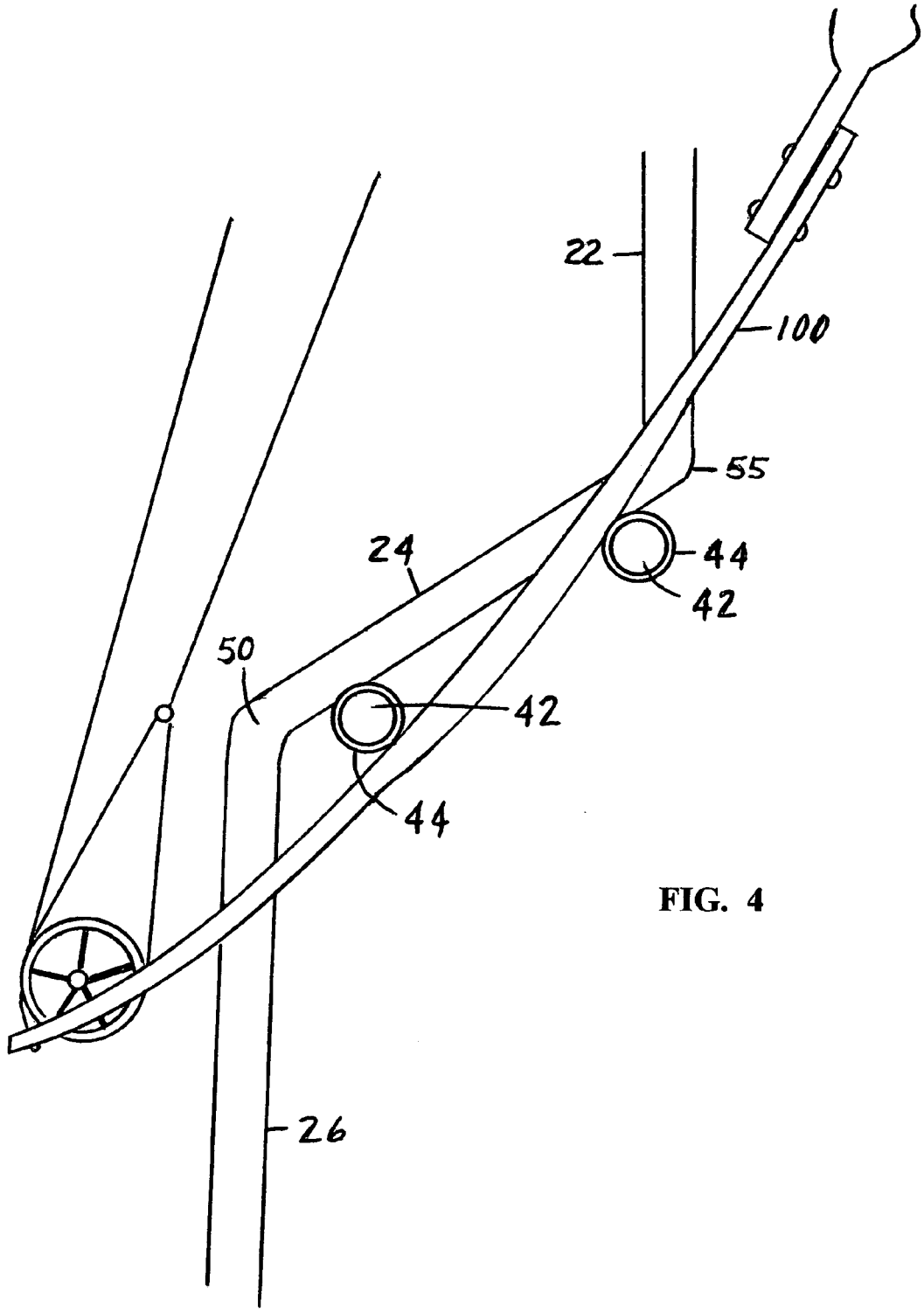
FIG. 4 is a view of a compound bow held within the two padded horizontal members of the archery bow and arrow stand.

A preferred embodiment includes the padded horizontal members 40 being two rounded metal members 42 attached perpendicularly to the angular middle portion 24 of the vertical support shaft 20, shown in FIGS. 3 and 4 of the drawings, with a rubberized padded coating 44 to provide a padded and friction enhancing covering between the padded horizontal members 40 and the bow 100 being placed upon the padded horizontal members 40, as shown in FIG. 4 of the drawings.

Also most preferred as shown in FIGS. 1 and 4, would be to have a first angle 50 between the lower vertical portion 26 and the angular middle portion 24 of the vertical shaft 20 of approximately 120 degrees, and a second angle 55 between the angular middle portion 24 and the upper vertical portion 22 also approximately 120 degrees, the upper vertical portion 22 and the lower vertical portion 26 being parallel.

Figure 2:
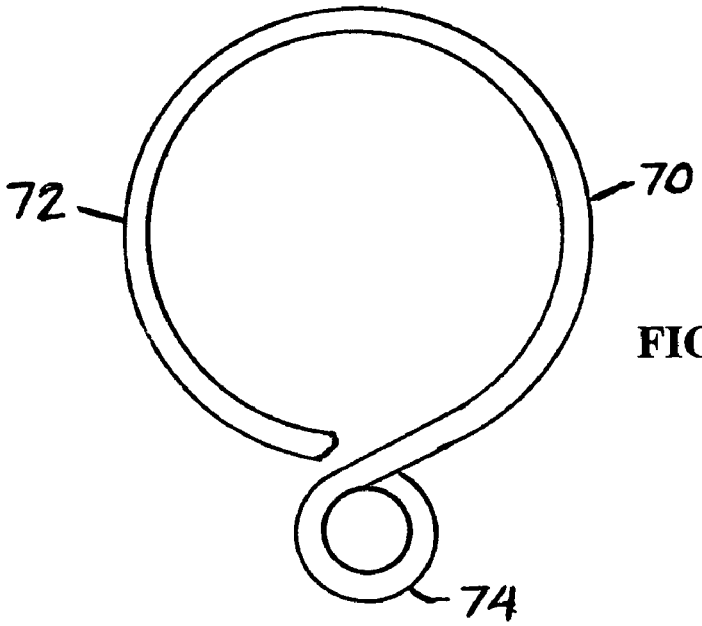
FIG. 2 is an upper view of one of the detachable quiver brackets.

The quiver 60 has a slight narrowing taper from a top portion 62 to a bottom portion 64 of the quiver, shown in FIG. 1. The at least two detachable quiver brackets 70 engage the quiver 60 within a first large diameter loop 72, one detachable quiver bracket 70 above the other, and also removably engage the lower vertical portion 26 of the vertical support shaft 20 by a round offset coil 74, as shown in FIG. 2 of the drawings. This rounded offset coil 74 allows the adjustable quiver bracket 70 to be slid up and down the lower vertical portion 26 by slightly elevating the large diameter loop 72 and sliding the found offset coil 74 of the quiver bracket 70 to a desired height on the lower vertical portion 26. It is also contemplated that the detachable quiver brackets 70 may be permanently affixed to the lower vertical portion 26 which would, of course, make them not detachable.

The magnetic accessory bowl 80 has an upper cavity 82 which is concave. A magnetic ring 84 is placed on a lower surface 86 of the magnetic accessory bowl 80 near where the magnetic accessory bowl 80 attaches to the upper vertical portion 22 of the vertical support shaft 20, as shown in FIG. 1 of the drawings.

While the invention has been particularly shown and described with reference to a preferred embodiment thereof, it will be understood by those skilled in the art that changes in form and detail may be made therein without departing from the spirit and scope of the invention.

What is claimed is:

1. A bow and arrow stand engaging the ground and holding an archery bow in an erect and upright position without contact with the bow string or the end of the bow, comprises essentially:

a vertical support shaft with an angular middle portion, an upper vertical portion and a lower vertical portion, said lower vertical portion having a ground end tapered into a point for insertion into the ground;

two padded horizontal members attached to said angular middle portion;

an arrow quiver suspended from said lower vertical portion by at least two detachable quiver brackets;

a secondary ground spike with a horizontal arm attaching said secondary ground spike to said lower vertical portion, said horizontal arm providing a location for foot pressure to drive said secondary ground spike and said ground end of the lower vertical portion into the ground; and a magnetic accessory bowl attached to the upper vertical portion.

2. The bow and arrow stand, as disclosed in claim 1, further comprising:

said padded horizontal members are two rounded metal members attached perpendicularly to said angular middle portion of the vertical support shaft with a rubberized padded coating to provide a padded and friction enhancing covering between said padded horizontal members and the bow being placed upon said padded horizontal members;

a first angle between said lower vertical portion and said angular middle portion of said vertical shaft is approximately 120 degrees, and a second angle between said angular middle portion and said upper vertical portion is also approximately 120 degrees, said upper vertical portion and said lower vertical portion being parallel; and said magnetic accessory bowl has a concave upper cavity and a magnetic ring on a lower surface of said magnetic accessory bowl where said magnetic accessory bowl attaches to said upper vertical portion of said vertical support shaft.

3. The bow and arrow stand, as disclosed in claim 1, further comprising:

said arrow quiver has a slight narrowing taper from a top portion to a bottom portion of said arrow quiver; and said at least two detachable quiver brackets engage said quiver within a first large diameter loop, one of said detachable quiver brackets above the other, and also removably engaging said lower vertical portion of said support shaft by a round offset coil allowing each said two detachable quiver brackets to be slid up and down said lower vertical portion by slightly elevating said large diameter loop and sliding each said two detachable quiver brackets upon said lower vertical portion.

* * * * *